US010124817B2

(12) United States Patent
Yoshida et al.

(10) Patent No.: US 10,124,817 B2
(45) Date of Patent: Nov. 13, 2018

(54) CARBODY OF RAILCAR

(71) Applicant: KAWASAKI JUKGYO KABUSHIKI KAISHA, Kobe-shi, Hyogo (JP)

(72) Inventors: Naohiro Yoshida, Kobe (JP); Naoaki Kawakami, Kobe (JP); Hiroyuki Sakurai, Akashi (JP)

(73) Assignee: KAWASAKI JUKOGYO KABUSHIKI KAISHA, Kobe-shi (JP)

( * ) Notice: Subject to any disclaimer, the term of this patent is extended or adjusted under 35 U.S.C. 154(b) by 154 days.

(21) Appl. No.: 15/116,995

(22) PCT Filed: Feb. 5, 2014

(86) PCT No.: PCT/JP2014/000614

§ 371 (c)(1),
(2) Date: Aug. 5, 2016

(87) PCT Pub. No.: WO2015/118571

PCT Pub. Date: Aug. 13, 2015

(65) Prior Publication Data

US 2017/0144677 A1 May 25, 2017

(51) Int. Cl.

| | |
|---|---|
| ***B61D 17/08*** | (2006.01) |
| ***B61D 17/12*** | (2006.01) |
| ***B61D 17/04*** | (2006.01) |

(52) U.S. Cl.

CPC ..... *B61D 17/08* (2013.01); *B61D 17/041* (2013.01); *B61D 17/12* (2013.01)

(58) Field of Classification Search

CPC ..... B61D 17/041; B61D 17/08; B61D 17/12; B61D 17/043; B61D 17/045; B61D 17/00

USPC ..... 105/400, 401

See application file for complete search history.

(56) References Cited

FOREIGN PATENT DOCUMENTS

| | | | |
|---|---|---|---|
| DE | 43 01 763 | * | 7/1994 |
| EP | 0622285 | A1 | 11/1994 |
| JP | H02-114058 | A | 4/1990 |
| JP | 2896354 | B2 | 5/1999 |
| SG | 192790 | * | 1/2013 |
| WO | 2012/117576 | A1 | 9/2012 |

OTHER PUBLICATIONS

May 20, 2014 International Search Report issued in Patent Application No. PCT/JP2014/000614.

May 20, 2014 Written Opinion issued in Patent Application No. PCT/JP2014/000614.

* cited by examiner

*Primary Examiner* — Mark T Le

(74) *Attorney, Agent, or Firm* — Oliff PLC

(57) ABSTRACT

A carbody of a railcar includes a roof bodyshell, a side bodyshell, and a cantrail. The cantrail includes: an outside plate; an inside plate arranged at a car inner side of the outside plate and spaced apart from the outside plate; and a plurality of coupling rib plates coupled to the outside plate and the inside plate and forming a plurality of triangles together with the outside plate and the inside plate. Each of the outside plate and the inside plate includes a plurality of sections each connecting apexes of the triangle. The plurality of sections of at least one of the outside plate and the inside plate include a plurality of flat plate sections. In the at least one plate, two or more adjacent flat plate sections among the plurality of flat plate sections are arranged on a straight line.

17 Claims, 4 Drawing Sheets

CARBODY OF RAILCAR

TECHNICAL FIELD

The present invention relates to a carbody of a railcar, the carbody being configured such that a roof bodyshell and a side bodyshell are connected to each other through a cantrail.

BACKGROUND ART

Regarding a carbody of a railcar, conventionally known is a bodyshell using a predetermined-shape hollow section formed by extrusion using an aluminum alloy and the like as materials for the purpose of reducing the weight and the number of parts, improving the productivity, and the like. For example, in PTL 1, a closed cross section member is provided in a region of a cantrail between a roof block and a side block. The closed cross section member includes a hollow side joint member, a hollow shoulder member, and a hollow roof joint member, which are individually formed by extrusion, and the side joint member, the shoulder member, and the roof joint member are welded to one another. In the shoulder member, a bent point of a bent-shaped outside plate and a middle portion of a circular-arc inside plate are coupled to each other by a rib. However, each of the side joint member and the roof joint member is not provided with a rib for coupling.

For example, when a car enters or comes out of a tunnel, or when the car travels in the tunnel, a difference between internal pressure and external pressure of a carbody is generated by a fluctuation in air pressure outside the car, and therefore, external force called an airtight load acts on the bodyshell. Since railcars are increasing in speed in recent years, the strength of the bodyshell needs to be designed by adequately considering the airtight load. The bodyshell of PTL 1 is formed to have a cross section similar to a frame structure. Since each quadrangle of the cross section of the bodyshell may deform by the airtight load, bending resistance of the entire bodyshell resists against the deformation. Therefore, large bending stress acts on a corner portion of the bodyshell. Thus, the strength of the cantrail needs to be adequately increased.

PTL 2 discloses a double skin bodyshell including a cantrail formed to have a cross section similar to a truss structure by coupling a plurality of dividing wall portions to an outer side plate portion and an inner side plate portion such that a plurality of triangles are formed. Since the cantrail is formed such that a basic cross-sectional shape line obtained by virtually coupling apexes of the triangles of the cross section of the cantrail has a circular-arc shape, a largely bent portion is not formed, and therefore, local concentration of stress by a bending moment is prevented. In addition, since all of sections forming the triangles at the inner side plate portion and the outer side plate portion are made flat, a load transferred to the inner side plate portion and the outer side plate portion is received as in-plane stress, and therefore, out-of-plane deformation is prevented.

CITATION LIST

Patent Literature

PTL 1: Japanese Laid-Open Patent Application Publication No. 2-114058

PTL 2: Japanese Patent No. 2896354

SUMMARY OF INVENTION

Technical Problem

According to the cantrail of PTL 2, the basic cross-sectional shape line has the circular-arc shape, and each of the inner side plate portion and the outer side plate portion is bent at all of the apexes of the triangles, that is, has a polygonal shape. Therefore, when the airtight load acting on the bodyshell is large, a bending load acting on the apex of the triangle becomes large. On this account, the cantrail needs to be entirely increased in thickness to increase the strength by adequately considering the bending loads at all the apexes. If the cantrail is entirely increased in thickness, an inner space of the railcar decreases, and the weight of the railcar increases.

An object of the present invention is to provide a structure capable of suppressing an increase in thickness of a cantrail in a carbody of a railcar by improving a cantrail having a truss structure cross section.

Solution to Problem

A carbody of a railcar according to the present invention includes: a roof bodyshell; a side bodyshell; and a cantrail, the roof bodyshell and the side bodyshell being connected to each other through the cantrail, the cantrail including an outside plate, an inside plate arranged at a car inner side of the outside plate and spaced apart from the outside plate, and a plurality of coupling rib plates coupled to the outside plate and the inside plate and forming a plurality of triangles of a truss shape together with the outside plate and the inside plate, the outside plate and the inside plate each including a plurality of sections each connecting apexes of the triangle, a plurality of flat plate sections being included in the plurality of sections of at least one of the outside plate and the inside plate, and among the plurality of flat plate sections of the at least one plate, two or more adjacent flat plate sections being arranged on a straight line.

According to the above configuration, in the cantrail having a truss structure cross section, two or more adjacent flat plate sections are arranged on the straight line. Therefore, even when an airtight load acting on the bodyshell significantly fluctuates, the generation of the bending load is suppressed at a connecting point (the apex of the triangle) between the adjacent flat plate sections on the straight line. On this account, the strength of the cantrail can be structurally improved, and the increase in thickness of the cantrail can be suppressed.

Advantageous Effects of Invention

As is clear from the above explanation, according to the present invention, the strength of the cantrail is structurally improved, and the increase in thickness of the cantrail can be suppressed.

DESCRIPTION OF EMBODIMENTS

Hereinafter, an embodiment will be explained in reference to the drawings.

Figure 1:
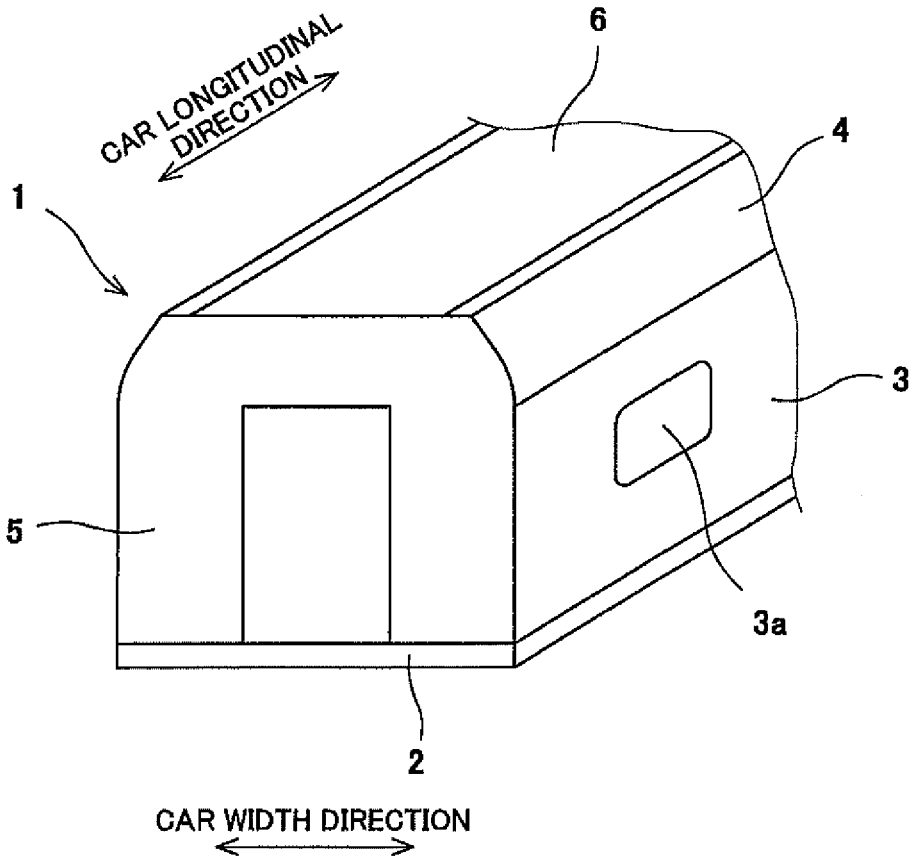
FIG. 1 is a perspective view showing a carbody of a railcar according to an embodiment.

FIG. 1 is a perspective view showing a carbody 1 of a railcar according to the embodiment. As shown in FIG. 1, the carbody 1 of the railcar includes: an underframe 2 as a bottom portion of the carbody; a pair of left and right side bodyshells 3, on each of which an opening portion 3*a* used for a window or an entrance is formed and each of which includes a lower end portion connected to one of both car width direction side portions of the underframe 2; cantrails 4 each having a lower end portion connected to an upper end portion of the side bodyshell 3; end bodyshells 5 each having a lower end portion connected to one of both car longitudinal direction end portions of the underframe 2; and a roof bodyshell 6 connected to upper end portions of the cantrails 4 and upper end portions of the end bodyshells 5. The side bodyshell 3 extending in a vertical direction and the roof bodyshell 6 extending in a horizontal direction are connected to each other through the cantrail 4. Therefore, the cantrail 4 has a bent shape that is convex substantially toward a car outer side as a whole when viewed from a car longitudinal direction.

Figure 2:
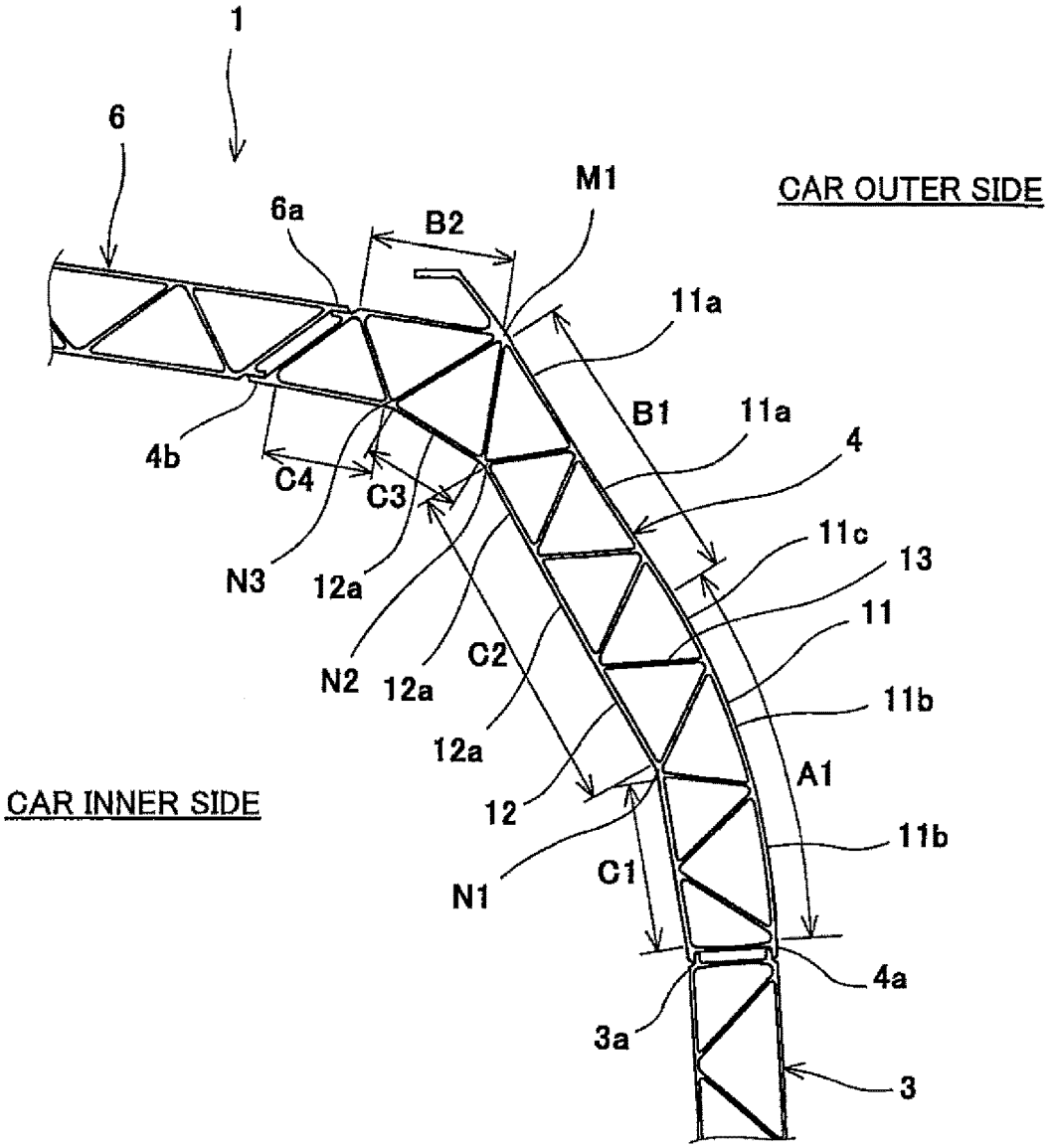
FIG. 2 is a cross-sectional view showing major components including a cantrail in a cross section of the carbody of FIG. 1, the cross section being perpendicular to a car longitudinal direction.
Figure 3:
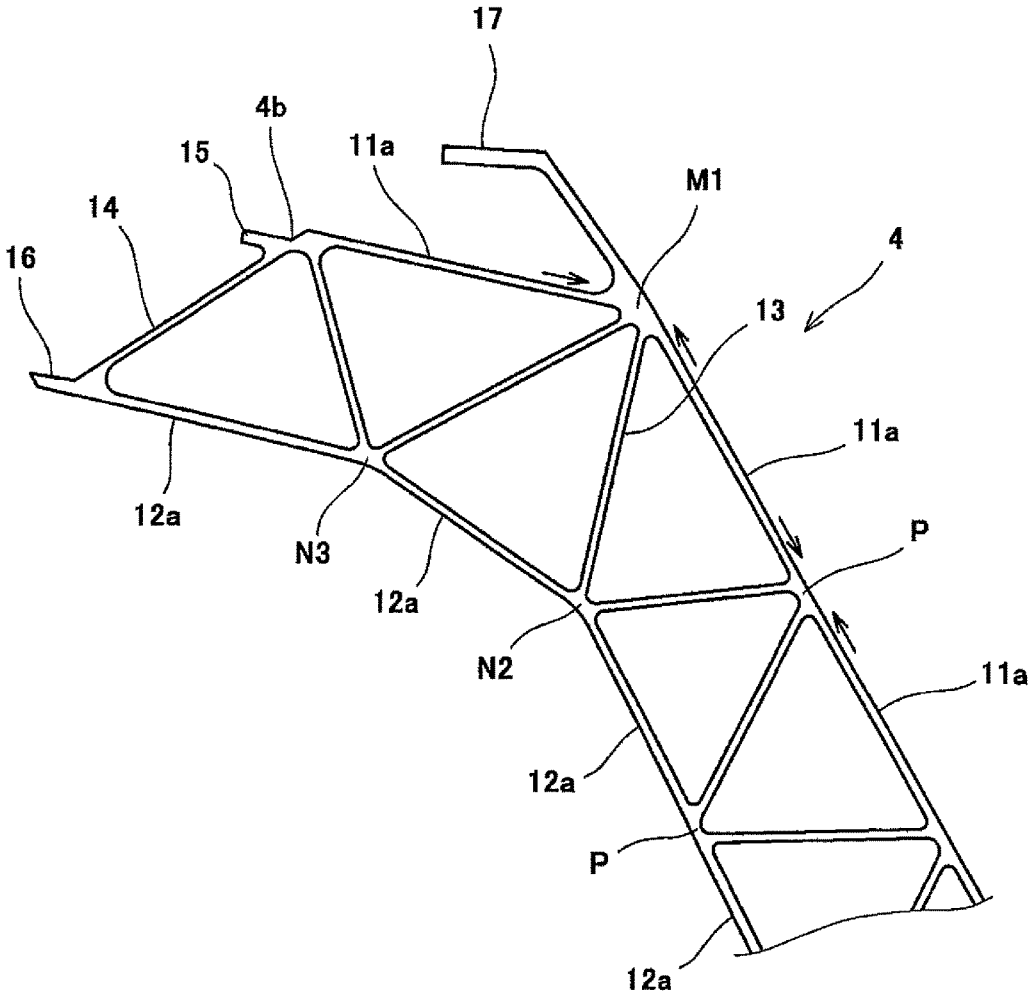
FIG. 3 is an enlarged cross-sectional view showing a part of the cantrail of FIG. 2.
Figure 4:
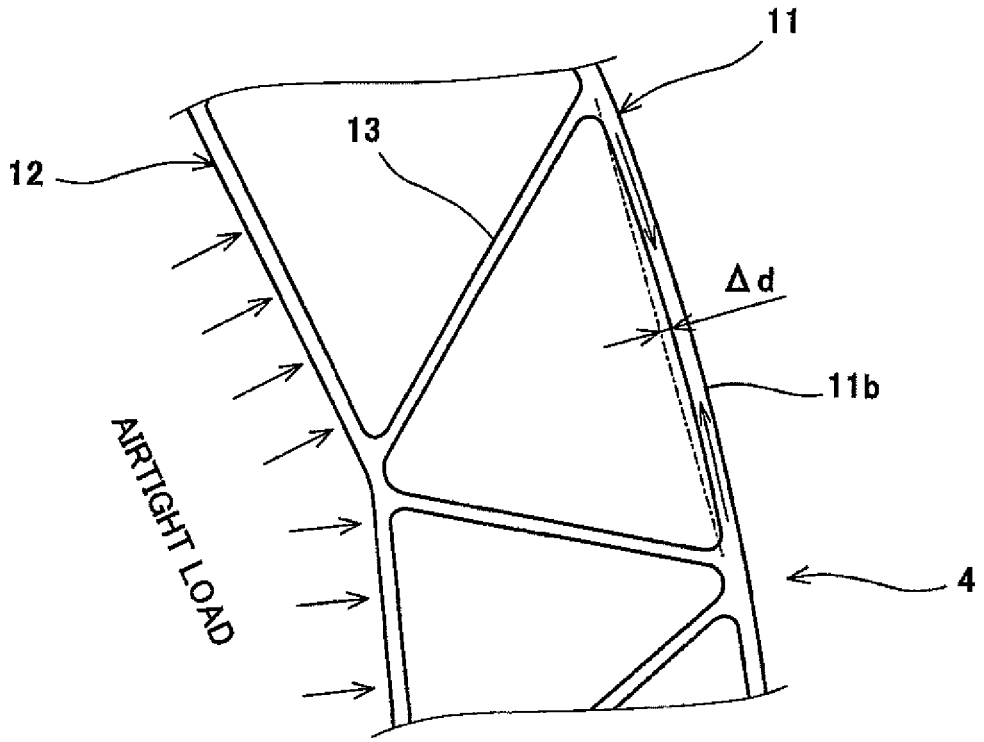
FIG. 4 is an enlarged cross-sectional view showing another part of the cantrail of FIG. 2.

FIG. 2 is a cross-sectional view showing major components including the cantrail 4 in a cross section of the carbody 1 of FIG. 1, the cross section being perpendicular to the car longitudinal direction. FIG. 3 is an enlarged cross-sectional view showing a part of the cantrail 4 of FIG. 2. FIG. 4 is an enlarged cross-sectional view showing another part of the cantrail 4 of FIG. 2. As shown in FIG. 2, a lower end portion 4*a* of the cantrail 4 is joined to an upper end portion 3*a* of the side bodyshell 3 by welding along the car longitudinal direction, and an upper end portion 4*b* of the cantrail 4 is joined to a car width direction end portion 6*a* of the roof bodyshell 6 by welding along the car longitudinal direction. The cantrail 4 includes: an outside plate 11; an inside plate 12 arranged at a car inner side of the outside plate 11 and spaced apart from the outside plate 11; and a plurality of coupling rib plates 13 that are coupled to the outside plate 11 and the inside plate 12 and form a plurality of triangles together with the outside plate 11 and the inside plate 12, the triangles forming a truss shape. To be specific, the cantrail 4 is a double skin bodyshell having a truss structure cross section and is integrally formed by extrusion using metal such as an aluminium alloy.

The outside plate 11 includes a circular-arc portion A1 at a lower side thereof. The outside plate 11 includes: a first linear portion B1 upwardly continuous with the circular-arc portion A1; and a second linear portion B2 upwardly continuous with the first linear portion B1 and having a different arrangement angle from the first linear portion B1. The first linear portion B1 is inclined relative to the vertical direction such that an upper side thereof is located at an inner side in a car width direction. The second linear portion B2 is inclined relative to the vertical direction such that an upper side thereof is located at the inner side in the car width direction. An inclination angle of the second linear portion B2 is larger than the inclination angle of the first linear portion B1. To be specific, since the first linear portion B1 and the second linear portion B2 have the respective angles, one bent point M1 projecting toward the car outer side is formed at the outside plate 11. The first linear portion B1 is interposed between the circular-arc portion A1 and the bent point M1.

The outside plate 11 includes a plurality of flat plate sections 11*a* and a plurality of curved plate sections 11*b*. Each of the flat plate sections 11*a* is a section connecting two apexes of a hollow triangle of the truss structure, the two apexes being located at the outside plate 11 side. A neutral line passing through a thickness-direction center of the flat plate section 11*a* is a straight line. Each of the curved plate sections 11*b* is a section connecting two apexes of a hollow triangle of the truss structure, the two apexes being located at the outside plate 11 side. A neutral line passing through a thickness-direction center of the curved plate section 11*b* has a circular-arc shape that is convex toward the car outer side. The outside plate 11 further includes one mixed section 11*c* sandwiched between the flat plate section 11*a* and the curved plate section 11*b*. The mixed section lie is a section connecting two apexes of a hollow triangle of the truss structure, the two apexes being located at the outside plate 11 side. The mixed section 11*c* includes: a curved plate portion in which a neutral line passing through a thickness-direction center thereof is convex toward the car outer side; and a flat plate portion smoothly continuous with the curved plate portion.

The circular-arc portion A1 of the outside plate 11 includes the plurality of curved plate sections 11*b* continuously lined up from a lower end portion of the outside plate 11. Specifically, the circular-arc portion A1 is formed by the plurality of curved plate sections 11*b* and the curved plate portion of the mixed section 11*c*. The first linear portion B1 of the outside plate 11 includes the plurality of flat plate sections 11*a* arranged so as to be lined up on a single straight line. Specifically, the first linear portion B1 is formed such that the plurality of flat plate sections 11*a* and the flat plate portion of the mixed section 11*c* are arranged so as to be lined up on a single straight line. The second linear portion B1 of the outside plate 11 is formed by one flat plate section 11*a*. To be specific, a plurality of sections of the outside plate 11 includes the flat plate sections 11*a* and the curved plate sections 11*b*. In the outside plate 11, the number of flat plate sections 11*a* is larger than the number of curved plate sections 11*b*. The bent point M1 of the outside plate 11 is formed since two adjacent flat plate sections 11*a* have respective angles.

The inside plate 12 includes first to fourth linear portions C1 to C4 that are continuous with one another and have respective angles different from one another. Each of the first to fourth linear portions C1 to C4 is inclined relative to the vertical direction such that an upper side thereof is located at the inner side in the car width direction. The linear portion (C4 to C1) arranged at an upper side has a larger inclination angle. To be specific, since the first to fourth linear portions C1 to C4 adjacent to one another have respective angles, a plurality of (for example, three) bent points N1 to N3 projecting toward the car outer side are formed at the inside plate 12.

The inside plate 12 includes a plurality of flat plate sections 12*a*. Each of the flat plate sections 12*a* is a section connecting two apexes of a hollow triangle of the truss structure, the two apexes being located at the inside plate 12 side. A neutral line passing through a thickness-direction center of the flat plate section 12*a* is a straight line. Each of the first and second linear portions C1 and C2 of the inside plate 12 is formed such that a plurality of flat plate sections 12*a* are arranged so as to be lined up on a single straight line. The number of flat plate sections 12*a* of the second linear portion C2 is larger than the number of flat plate sections of the first linear portion C1. Each of the third and fourth linear portions C3 and C4 of the inside plate 12 is formed by one flat plate section 12*a*. Each of the bent points N1 to N3 of the inside plate 12 is formed since two adjacent flat plate sections 12*a* have respective angles. The inside plate 12 does not include a curved plate section, and the inside plate 12 is constituted by only the flat plate sections 12*a*.

A car outer side angle of the outside plate 11 at the bent point M1 is the largest among car outer side angles of the outside plate 11 at respective apexes of the triangles of the cantrail 4, the apexes being located at the outside plate 11 side. The bent point M1 of the outside plate 11 is also called a maximum bent point M1. The car outer side angle of the outside plate 11 at the maximum bent point M1 is larger than each of the car outer side angles of the inside plate 12 at respective apexes of the triangles of the cantrail 4, the apexes being located at the inside plate 12 side. To be specific, the car outer side angle of the outside plate 11 at the maximum bent point M1 is larger than each of the car outer side angles of the inside plate 12 at the bent points N1 to N3.

The number of bent points N1 to N3 of the inside plate 12 is larger than the number of bent points M1 of the outside plate 11. Specifically, the number of bent points N1 to N3 of the inside plate 12 is larger than twice the number of bent points M1 of the outside plate 11. In the present embodiment, the number of bent points N1 to N3 of the inside plate 12 is three, and the number of bent points M1 of the outside plate 11 is one. The outside plate 11 includes a plurality of linear portions B1 and B2 that are different in angle from each other, and the inside plate 12 includes a plurality of linear portions C1 to C4 that are different in angle from each other. The number of linear portions C1 to C4 of the inside plate 12 is larger than the number of linear portions B1 and B2 of the outside plate 11. Specifically, the number of linear portions C1 to C4 of the inside plate 12 is not less than twice the number of linear portions B1 and B2 of the outside plate 11. In the present embodiment, the number of linear portions C1 to C4 of the inside plate 12 is four, and the number of linear portions B1 and B2 of the outside plate 11 is two.

The number of linear portions C1 and C2 each formed by a plurality of flat plate sections 12*a* in the inside plate 12 is larger than the number of linear portions B1 each formed by a plurality of flat plate sections 11*a* in the outside plate 11. In the present embodiment, the number of linear portions C1 and C2 each formed by a plurality of flat plate sections 12*a* in the inside plate 12 is two, and the number of linear portions B1 each formed by a plurality of flat plate sections 11*a* in the outside plate 11 is one. The linear portion C2 that is the longest among the linear portions B1 and B2 of the outside plate 11 and the linear portions C1 to C4 of the inside plate 12 is provided at the inside plate 12. To be specific, the second linear portion C2 that is the longest among the first to fourth linear portions C1 to C4 of the inside plate 12 is longer than the first linear portion B1 that is the longest among the first and second linear portions B1 and B2 of the outside plate 11.

As shown in FIGS. 2 and 3, the first and second linear portions B1 and B2 each including the flat plate section(s) 11*a* are adjacently arranged at both respective sides of the maximum bent point M1 of the outside plate 11. A portion facing the car inner side of the maximum bent point M1 of the inside plate 12 is the flat plate section 12*a*, and an intermediate portion of the flat plate section 12*a* facing the maximum bent point M1 is not directly connected to the maximum bent point M1, that is, not coupled to the maximum bent point M1. The number of coupling rib portions 13 directly connected to the maximum bent point M1 is two. A cross-sectional area of the maximum bent point M1 is larger than each of cross-sectional areas of the bent points N1 to N3 of the cantrail 4. Further, the cross-sectional area of the maximum bent point M1 is larger than each of cross-sectional areas of apexes P each located between the adjacent flat plate sections 11*a* arranged on a single straight line and cross-sectional areas of apexes P each located between the adjacent flat plate sections 12*a* arranged on a single straight line.

An end plate 14 inclined relative to a thickness direction of the cantrail 4 is provided at the end portion 4*b* of the cantrail 4, the end portion 4*b* being located close to the roof bodyshell 6. The end plate 14 is inclined such that an upper portion thereof is located at a car width direction outer side of a lower portion thereof. A pair of upper and lower convex portions 15 and 16 fitted to the roof bodyshell 6 are provided at the upper and lower portions of the end plate 14, respectively so as to project toward the inner side in the car width direction. The upper convex portion 15 is located at a car width direction outer side of the lower convex portion 16. The cantrail 4 is provided with a bracket portion 17 projecting upward from the maximum bent portion M1 of the outside plate 11.

As shown in FIG. 2, the maximum bent point M1 of the outside plate 11 is arranged at an upper side of the cantrail 4. A length from the maximum bent point M1 to an end portion, close to the side bodyshell 3, of the outside plate 11 is longer than a length from the maximum bent point M1 to an end portion, close to the roof bodyshell 6, of the outside plate 11. A width of the entire cantrail 4 in the car width direction is smaller than a height of the entire cantrail 4 in the vertical direction. The first linear portion B1 of the outside plate 11 and the second linear portion C2 of the inside plate 12 are parallel to each other. The second linear portion B2 of the outside plate 11 and the fourth linear portion C4 of the inside plate 12 are parallel to each other. The first bent portion N1 is arranged at the inside plate 12 so as to be located in a region facing the car inner side of the circular-arc portion A1 of the outside plate 11.

Next, mechanical actions of an airtight load on the cantrail 4 having the truss structure cross section will be explained in reference to FIG. 4. A stress σ applied to the curved plate section 11*b* of the outside plate 11 is represented by Formula 1 below. In Formula 1, $\sigma_{bend}$ denotes a bending component stress, and $\sigma_{comp}$ denotes a simple compression component stress.

$$\sigma=\sigma_{bend}+\sigma_{comp} \quad \text{Formula 1}$$

The bending component stress $\sigma_{bend}$ is calculated by Formula 2 below, and the simple compression component stress $\sigma_{comp}$ is calculated by Formula 3 below. In Formulas 2 and 3, M denotes a moment applied to the outside plate 11, Z denotes a section modulus, Δd denotes a displacement amount between the outside plate 11 and a straight line connecting two apexes of the triangle, the two apexes being located at the outside plate 11 side, F denotes a compressive load of the outside plate 11, L denotes a car longitudinal direction size of the outside plate 11, and t denotes a thickness of the outside plate 11.

$$\sigma_{bend} = \frac{M}{Z} = \frac{6 \cdot \Delta d \cdot F}{L \cdot t^2} \quad \text{Formula 2}$$

$$\sigma_{comp} = \frac{F}{L \cdot t} \quad \text{Formula 3}$$

As is clear from Formulas 1 to 3, as the displacement amount Δd decreases, the bending component stress $\sigma_{bend}$ decreases. To be specific, the bending component stress $\sigma_{bend}$ corresponding to the displacement amount Δd is generated at the curved plate section 11*b*, and the bending component stress $\sigma_{bend}$ is not generated at the flat plate sections 11*a* and 12*a*. In the entire cantrail 4, the number of flat plate sections 11*a* and 12*a* is larger than half the number of sections 11*a*, 11*b*, 11*c*, and 12*a* of the outside and inside plates 11 and 12. In the present embodiment, the number of flat plate sections 11*a* and 12*a* is 10, and the number of sections 11*a*, 11*b*, 11*c*, and 12*a* of the outside and inside plates 11 and 12 is 13. In the outside plate 11, the number of flat plate sections 11*a* is not less than half the number of curved plate sections 11*b*. In the inside plate 12, all the sections are the flat plate sections 12*a*. Therefore, the airtight load transferred to the outside plate 11 and the inside plate 12 is received as in-plane stress by the flat plate sections 11*a* and 12*a*, and therefore, out-of-plane deformation is prevented.

Further, as shown in FIG. 3, for example, since directions of the in-plane stresses of the two flat plate sections 11*a* sandwiching the bent point M1 are not located on the same straight line, a bending load is generated at the bent point M1. The two or more adjacent flat plate sections 11*a* sandwiching the apex P or the two or more adjacent flat plate sections 12*a* sandwiching the apex P are arranged so as to be lined up on a straight line. Therefore, even when the airtight load acting on the cantrail 4 significantly fluctuates, the generation of the bending load is suppressed at a connecting point (the apex of the triangle) between the flat plate sections 11*a* adjacent to each other on the straight line or between the flat plate sections 12*a* adjacent to each other on the straight line. On this account, even when the outside plate 11 and the inside plate 12 are reduced in thickness to be reduced in weight, buckling by the out-of-plane deformation can be suitably prevented. Further, the stress generated at the maximum bent portion M1 is larger than each of the stress generated at the apex P between the adjacent flat plate sections 11*a* arranged on the straight line, the stress generated at the apex P between the adjacent flat plate sections 12*a* arranged on the straight line, and the stresses generated at the bent points N1 to N3 of the cantrail 4. The cross-sectional area of the maximum bent portion M1 is larger than each of the cross-sectional area of the apex P between the adjacent flat plate sections 11*a* arranged on the straight line, the cross-sectional area of the apex P between the adjacent flat plate sections 12*a* arranged on the straight line, and the cross-sectional areas of the bent points N1 to N3 of the cantrail 4. Therefore, the bending deformation at the maximum bent portion M1 is suitably prevented, and the strength of the cantrail 4 with respect to a car longitudinal direction compressive load applied to the cantrail 4 is improved.

The intermediate portion of the flat plate section 12*a* facing the car inner side of the maximum bent point M1 of the outside plate 11 is not directly connected to the maximum bent point M1, that is, not coupled to the maximum bent point M1. Therefore, the stress acting on the maximum bent portion M1 is prevented from acting on the flat plate section 12*a* as an out-of-plane direction local stress.

Since the number of bent points N1 to N3 of the inside plate 12 is larger than the number of bent points M1 of the outside plate 11, an inner space of the railcar can be efficiently widely secured. Since the outside plate 11 includes both the flat plate sections 11*a* and the curved plate sections 11*b*, the strength can be improved by the flat plate sections 11*a* while improving the appearance by the curved plate sections 11*b*. Especially, since the curved plate sections 11*b* of the present embodiment are provided at a lower portion of the outside plate 11 which portion tends to affect the appearance, both the appearance and the strength can be effectively improved.

Since the linear portion C2 that is the longest among the linear portions B1 and B2 of the outside plate 11 and the linear portions C1 to C4 of the inside plate 12 is provided at the inside plate 12, the adequate strength can be secured at the inside plate 12. Since a boundary between the circular-arc portion A1 and the first linear portion B1 in the outside plate 11 is located at not the apex of the triangle but an intermediate portion of the mixed section 11*c*, design freedom when setting the lengths of the first linear portion B1 and circular-arc portion A1 of the outside plate 11 is improved. Since the mixed section 11*c* faces the second linear portion C2 that is the longest in the inside plate 11, the strength of the cantrail 4 can be maintained satisfactorily.

As above, while improving the appearance of the cantrail 4, the strength of the cantrail 4 can be structurally improved, and the increase in thickness of the cantrail 4 can be suitably suppressed.

INDUSTRIAL APPLICABILITY

As above, the carbody of the railcar according to the present invention has an excellent effect of structurally improving the strength of the cantrail and suppressing the increase in thickness of the cantrail. It is useful to widely apply the present invention to railcars which can achieve the significance of this effect.

REFERENCE SIGNS LIST

1 carbody
3 side bodyshell
4 cantrail
6 roof bodyshell
11 outside plate
11*a* flat plate section
11*b* curved plate section
12 inside plate
12*a* flat plate section
13 coupling rib plate
A1 circular-arc portion
B1, B2, C1 to C4 linear portion
M1 maximum bent point
N1 to N3 bent point

The invention claimed is:

1. A carbody of a railcar,
the carbody comprising:
a roof bodyshell;
a side bodyshell; and
a cantrail,
the roof bodyshell and the side bodyshell being connected to each other through the cantrail,
the cantrail including
an outside plate,
an inside plate arranged at a car inner side of the outside plate and spaced apart from the outside plate, and
a plurality of coupling rib plates coupled to the outside plate and the inside plate and forming a plurality of triangles of a truss shape together with the outside plate and the inside plate, the outside plate and the inside plate each including a plurality of sections each connecting apexes of the plurality of triangles, a plurality of flat plate sections being included in the plurality of sections of at least one of the outside plate and the inside plate, among the plurality of flat plate sections of the at least one plate, two or more adjacent flat plate sections being arranged on a straight line, each of the outside plate and the inside plate being provided with at least one bent point projecting toward a car outer side since two adjacent flat plate sections among the plurality of flat plate sections have respective angles, as one of a plurality of apexes of the plurality of triangles, a maximum bent point projecting toward the car outer side being formed at the outside plate, a car outer side angle of the outside plate at the maximum bent point being largest among car outer side angles of the outside plate at the plurality of apexes, and a cross-sectional area of a region at the maximum bent point being larger than each of cross-sectional areas of regions at other bent points of the cantrail.

2. The carbody according to claim 1, wherein:

the outside plate includes the plurality of flat plate sections;

two or more adjacent flat plate sections among the plurality of flat plate sections are arranged on a straight line at at least one of both adjacent sides of the maximum bent point of the outside plate; and a portion of the inside plate which portion faces a car inner side of the maximum bent point is a flat plate section of the plurality of flat plate sections of the inside plate and an intermediate portion of the flat plate section facing the maximum bent point is not coupled to the maximum bent point.

3. The carbody according to claim 1, wherein:

the number of bent points of the inside plate is larger than the number of bent points of the outside plate.

4. The carbody according to claim 1, wherein the plurality of sections of the at least one plate includes the plurality of flat plate sections and at least one curved plate section.

5. The carbody according to claim 1, wherein:

each of the outside plate and the inside plate is provided with a linear portion formed by at least one of the flat plate sections; and the linear portion that is longest among the linear portion of the outside plate and the linear portion of the inside plate is provided at the inside plate.

6. The carbody according to claim 2, wherein:

the number of bent points of the inside plate is larger than the number of bent points of the outside plate.

7. The carbody according to claim 2, wherein the plurality of sections of the at least one plate includes the plurality of flat plate sections and at least one curved plate section.

8. The carbody according to claim 3, wherein the plurality of sections of the at least one plate includes the plurality of flat plate sections and at least one curved plate section.

9. The carbody according to claim 6, wherein the plurality of sections of the at least one plate includes the plurality of flat plate sections and at least one curved plate section.

10. The carbody according to claim 2, wherein:

each of the outside plate and the inside plate is provided with a linear portion formed by at least one of the flat plate sections; and the linear portion that is longest among the linear portion of the outside plate and the linear portion of the inside plate is provided at the inside plate.

11. The carbody according to claim 3, wherein:

each of the outside plate and the inside plate is provided with a linear portion formed by at least one of the flat plate sections; and the linear portion that is longest among the linear portion of the outside plate and the linear portion of the inside plate is provided at the inside plate.

12. The carbody according to claim 4, wherein:

each of the outside plate and the inside plate is provided with a linear portion formed by at least one of the flat plate sections; and the linear portion that is longest among the linear portion of the outside plate and the linear portion of the inside plate is provided at the inside plate.

13. The carbody according to claim 6, wherein:

each of the outside plate and the inside plate is provided with a linear portion formed by at least one of the flat plate sections; and the linear portion that is longest among the linear portion of the outside plate and the linear portion of the inside plate is provided at the inside plate.

14. The carbody according to claim 7, wherein:

each of the outside plate and the inside plate is provided with a linear portion formed by at least one of the flat plate sections; and the linear portion that is longest among the linear portion of the outside plate and the linear portion of the inside plate is provided at the inside plate.

15. The carbody according to claim 8, wherein:

each of the outside plate and the inside plate is provided with a linear portion formed by at least one of the flat plate sections; and the linear portion that is longest among the linear portion of the outside plate and the linear portion of the inside plate is provided at the inside plate.

16. The carbody according to claim 9, wherein:

each of the outside plate and the inside plate is provided with a linear portion formed by at least one of the flat plate sections; and the linear portion that is longest among the linear portion of the outside plate and the linear portion of the inside plate is provided at the inside plate.

17. A carbody of a railcar, the carbody comprising:

a roof bodyshell;

a side bodyshell; and a cantrail, the roof bodyshell and the side bodyshell being connected to each other through the cantrail, the cantrail including an outside plate, an inside plate arranged at a car inner side of the outside plate and spaced apart from the outside plate, and a plurality of coupling rib plates coupled to the outside plate and the inside plate and forming a plurality of triangles of a truss shape together with the outside plate and the inside plate, the outside plate and the inside plate each including a plurality of sections each connecting apexes of the plurality of triangles, a plurality of flat plate sections being included in the plurality of sections of at least one of the outside plate and the inside plate, among the plurality of flat plate sections of the at least one plate, two or more adjacent flat plate sections being arranged on a straight line, as one of a plurality of apexes of the plurality of triangles, a maximum bent point projecting toward a car outer side being formed at the outside plate;

a car outer side angle of the outside plate at the maximum bent point being largest among car outer side angles of the outside plate at the plurality of apexes; and a cross-sectional area of a region at the maximum bent point being larger than each of cross-sectional areas of regions at apexes each located between adjacent flat plate sections arranged on a single straight line.

* * * * *